US012025410B2

(12) United States Patent
Southworth

(10) Patent No.: US 12,025,410 B2
(45) Date of Patent: Jul. 2, 2024

(54) NON-LETHAL DISRUPTION DEVICE

(71) Applicant: Scott Douglas Southworth, Centennial, CO (US)

(72) Inventor: Scott Douglas Southworth, Centennial, CO (US)

( * ) Notice: Subject to any disclaimer, the term of this patent is extended or adjusted under 35 U.S.C. 154(b) by 80 days.

(21) Appl. No.: 17/734,006

(22) Filed: Apr. 30, 2022

(65) Prior Publication Data

US 2022/0349680 A1 Nov. 3, 2022

Related U.S. Application Data

(60) Provisional application No. 63/182,893, filed on May 1, 2021.

(51) Int. Cl.
*F41H 13/00* (2006.01)

(52) U.S. Cl.
CPC ..... *F41H 13/0087* (2013.01); *F41H 13/0081* (2013.01)

(58) Field of Classification Search
CPC ..... F41H 13/0087; F41H 13/0081; F41H 13/0043; F41H 13/0056
See application file for complete search history.

(56) References Cited

U.S. PATENT DOCUMENTS 2,908,901 A * 10/1959 Rubin ..... F21V 15/01 362/102
4,703,402 A * 10/1987 Hsieh ..... F41H 13/0018 362/183
4,959,637 A * 9/1990 Woods ..... G08B 21/0415 340/539.11
5,476,192 A * 12/1995 Julinot ..... B65D 83/22 116/DIG. 44
5,549,220 A * 8/1996 Whalen ..... F41H 13/0087 222/113
5,578,992 A * 11/1996 Harding ..... G08B 15/004 362/253
5,952,916 A * 9/1999 Yamabe ..... B25D 1/00 340/331
7,069,926 B2 * 7/2006 Skellern ..... B05B 15/00 128/202.16
8,419,213 B1 * 4/2013 Rubtsov ..... H05B 45/20 362/249.02
8,894,234 B2 * 11/2014 Kuo ..... F41B 15/02 362/120
9,377,276 B1 * 6/2016 Jiang ..... F41H 13/0006
10,578,292 B1 * 3/2020 Yamasaki ..... F41H 13/0087
11,156,438 B2 * 10/2021 Yang ..... F21V 33/0076
2007/0039226 A1 * 2/2007 Stokes ..... F41G 1/35 42/146
2007/0086190 A1 * 4/2007 Kukuk ..... F41C 23/10 362/253
2008/0013311 A1 * 1/2008 Rubtsov ..... H05B 45/32 362/231
2008/0158859 A1 * 7/2008 McMeekin ..... F41H 9/10 222/113

(Continued)

*Primary Examiner* — Joshua E Freeman

(57) ABSTRACT

This disclosure generally relates to a non-lethal disruption device that is meant to disorient and/or confuse an individual using lights and/or sound. The lights and/or sound are emitted from the non-lethal disruption device at a particular pattern and/or frequency in response to a triggering event.

20 Claims, 5 Drawing Sheets

(56) References Cited

U.S. PATENT DOCUMENTS

| | | | | |
|---|---|---|---|---|
| 2012/0274447 | A1* | 11/2012 | Hess | G08B 13/191 340/8.1 |
| 2013/0265749 | A1* | 10/2013 | O'Brien | F21L 4/022 362/184 |
| 2013/0321128 | A1* | 12/2013 | Stewart | F21L 4/005 340/6.1 |
| 2014/0085875 | A1* | 3/2014 | Yang | F21V 33/0076 362/183 |
| 2017/0067605 | A1* | 3/2017 | Kuo | F41H 13/0087 |
| 2018/0064093 | A1* | 3/2018 | Spence | A01M 29/10 |
| 2018/0262545 | A1* | 9/2018 | Alexander | H04L 65/61 |
| 2019/0271528 | A1* | 9/2019 | Nangunoori | F41H 9/10 |
| 2020/0400304 | A1* | 12/2020 | Harvey | F41H 9/10 |
| 2021/0254937 | A1* | 8/2021 | Hoelzl | F41H 13/0081 |
| 2022/0013001 | A1* | 1/2022 | Thomas | H04N 5/772 |
| 2022/0373168 | A1* | 11/2022 | Stallings | F21V 23/0414 |

* cited by examiner

NON-LETHAL DISRUPTION DEVICE

CROSS-REFERENCE TO RELATED APPLICATION

The present application claims priority to U.S. Provisional Patent Application No. 63/182,893, filed May 1, 2021 and titled "Reconnaissance and Intelligence Gathering Device Having a Disruption Feature", the entire disclosure of which is hereby incorporated by reference in its entirety.

BACKGROUND

Law enforcement officers are often in volatile and/or high stress environments and situations. For example, during encounters between individuals and law enforcement officers, tensions may run high and the already volatile situation may escalate. In such cases, the safety of the law enforcement officers and the safety of the individual may be at risk. Since the safety of the law enforcement officers, and the people whom they serve and interact with, is of utmost importance, it would be beneficial for law enforcement officers to have a non-lethal device that disrupts potential unsafe and/or harmful actions by individuals.

SUMMARY

This disclosure generally relates to a non-lethal disruption device that is meant to disorient and/or confuse an individual using lights and/or sound. The lights and/or sound are emitted from the non-lethal disruption device at a particular pattern and/or frequency in response to a triggering event. The non-lethal disruption device may be implemented in a number of different devices and/or have a number of different applications including personal use, military use, law enforcement use and so on.

Accordingly, the present application describes a non-lethal disruption device that includes a switch associated with a housing and a sound chamber for emitting a sound a particular frequency. The non-lethal disruption device also includes one or more light sources. In an example, the non-lethal disruption device operates in a first operation mode in which the one or more light sources emit a first type of light in response to a first actuation of the switch. The non-lethal disruption device also operates in a second operation mode in which the one or more light sources emit a second type of light and the sound chamber emits the sound in response to a second actuation of the switch.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Examples may be practiced as methods, systems or devices. Accordingly, examples may take the form of a hardware implementation, an entirely software implementation, or an implementation combining software and hardware aspects. The following detailed description is therefore not to be taken in a limiting sense, and the scope of the present disclosure is defined by the appended claims and their equivalents.

The present application describes a non-lethal disruption device that uses lights and/or sounds to provide a temporary disorienting effect to an individual. The non-lethal disruption device may have many uses and applications including, but not limited to, use by law enforcement officers, military personnel, and civilians. For example, in a first use case, the non-lethal disruption device may be a flashlight or other handheld device. In another example, the non-lethal disruption device may be a reconnaissance device. In yet another example, the non-lethal disruption device may be removably attached to or otherwise integrated with a personal computing device (e.g., a mobile phone). As will be explained in greater detail below, the lights and/or sounds of the non-lethal disruption device may be triggered or otherwise activated by a trigger event. The trigger event may be local to the device (e.g., by the push of a button) or via a remote signal (e.g., a signal received via a wireless signal or a signal received via a network).

These and other examples will be shown and described in more detail with respect to FIG. 1-FIG. 7.

Figure 1:
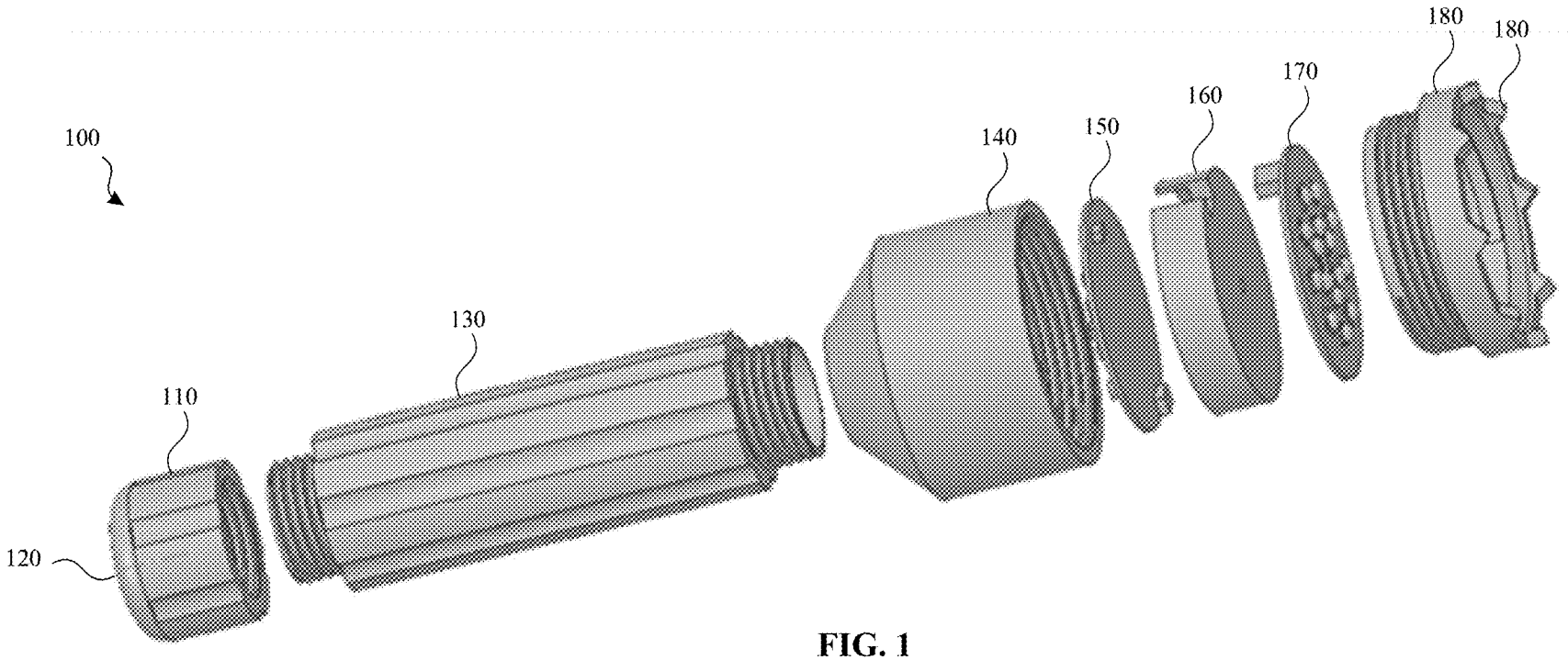
FIG. 1 illustrates a non-lethal disruption device according to an example.

FIG. 1 illustrates an exploded perspective view of a non-lethal disruption device 100 according to an example. In the example shown in FIG. 1, the non-lethal disruption device 100 may resemble, be integrated with, or otherwise have the form of a flashlight or other handheld device. Although a flashlight is specifically shown and described with respect to FIG. 1, one or more of the various components described with reference to FIG. 1 may be used in or otherwise be associated with a number of different devices and/or mechanisms.

The non-lethal disruption device 100 may include an endcap 110 having an associated switch 120. The switch 120 may be a button or other depressible/moveable mechanism that enables an individual to activate, arm, and/or deactivate the non-lethal disruption device 100. In one example, the non-lethal disruption device 100 may have different operating states or modes.

For example, in a first operating mode, the individual may use the non-lethal disruption device 100 as a flashlight by depressing or otherwise actuating the switch 120 a first time, in a first manner (e.g., a quick actuation) and/or for a first amount of time (e.g., one second, two seconds). Although a switch 120 is shown as being associated or otherwise integrated with the endcap 110, the switch 120 may be remote from the endcap. For example, the switch 120 may be a wired or wireless switch that, when activated, causes the non-lethal disruption device 100 to function in a similar manner such as described herein.

In an example, when the switch 120 is actuated, a light board 170 of the non-lethal disruption device 100 may enter a first mode of operation. For example, the non-lethal disruption device 100 may emit light from one or more light sources. In this example, the light may be emitted in a first light pattern and/or color (e.g., steady white light). Thus, the non-lethal disruption device 100 may act as a light emitting device similar to a flashlight.

However, when a trigger event is detected, the non-lethal disruption device 100 may enter an "armed" state or a second operating mode in which different colored light (e.g., multi-colored lights) are emitted from the light sources at a particular frequency and/or pattern. For example, a frequency range associated with the lights may sweep a programmed range over a period of time to create maximum disturbance to an intended target Additionally, the non-lethal disruption device 100 may simultaneously or substantially simultaneously emit sound at a particular decibel level and/or frequency. Like the lights, a frequency range associated with the sounds may sweep a programmed range over a period of time to create maximum disturbance to an intended target.

In one example, the trigger event may be a subsequent actuation of the switch 120, actuation of the switch 120 in a second manner (e.g., press and holding the switch 120, multiple actuations within a given period of time) and/or actuation of the switch 120 for over a predetermined amount of time (e.g., two seconds). In another example, the trigger event may be detected via a sensor associated with the non-lethal disruption device 100.

For example, the sensor may be a microphone that detects a trigger word, a voice command, a sound or other data that causes the non-lethal disruption device 100 to be activated. In yet another example, the non-lethal disruption device 100 may be armed via a remote command (e.g., a command received from a remote device via a wireless or network connection) and/or upon activation of another device (e.g., a body camera or other recording device).

In yet another example, the sensor may be an accelerometer that detects movement of the non-lethal disruption device 100. In response to detecting the movement, the second mode of the non-lethal disruption device 100 may be armed and/or activated. In one example, although the non-lethal disruption device 100 may be armed, the second mode will not be activated until the trigger event is detected.

If the non-lethal disruption device 100 is in the first operating mode (e.g., the flashlight mode), the first operating mode may be deactivated by a subsequent actuation of the switch 120 and/or actuation of the switch 120 in a particular manner (e.g., similar to the manner in which the first operating mode was entered). Likewise, if the non-lethal disruption device 100 is in the second operating mode (e.g., the armed or disruption mode), the second operating mode may be deactivated by a similar (or different) subsequent actuation of the switch 120 and/or in a manner similar to the manner in which the second operating mode was entered. In another example, the second operating mode may be deactivated after a predetermined amount of time has passed (e.g., five seconds) and/or may be deactivated based on information received from a sensor (e.g., a voice command, accelerometer data).

The endcap 110 of the non-lethal disruption device 100 may be removably coupled to a proximal end of the body 130. The body 130 may house a battery or other power supply that provides power to the non-lethal disruption device 100. The battery may be rechargeable or may be disposable. The body 130 and/or the other components described herein may be made from any suitable material including, metal, steel, plastic and so on.

The non-lethal disruption device 100 may also include a headpiece 140. The headpiece 140 may be removably coupled to a distal end of the body 130. The headpiece 140 may be shaped or otherwise configured to house a circuit board 150, a sound chamber 160 and a light panel 170 of the non-lethal disruption device 100. For example, the headpiece 140 may be cylindrical or cone shaped. Although specific shapes are described, the headpiece 140, as well as the other components described herein, may have any shape.

As briefly mentioned above, the non-lethal disruption device 100 may include a circuit board 150. The circuit board 150 may include various electronic components (e.g., resistors, capacitors, sound emitting components, memory, communication components, processor) that may be used to activate and/or control the various lights and/or sounds (including the frequency and/or patterns of the lights and sound) emitted by the non-lethal disruption device 100. The circuit board 150 may be configured to mate with or otherwise be at least partially received by a sound chamber 160.

The sound chamber 160 may include a piezo bender, a diaphragm or other sound emitting/amplifying device. In an example, the sound chamber 160 may operate at a resonant frequency of 3700 Hz and a capacitance of 48000 pF at 120 Hz. Although specific frequencies and capacitance are mentioned, other frequencies and capacitance may be used.

The non-lethal disruption device 100 may also include a light board 170. The light board 170 includes a number of different light sources arranged in a particular pattern or arrangement. In one example, each light source on the light board 170 may be spaced approximately three millimeters from an adjacent light source in one or more directions. In one example, the light sources of the light board 170 are LED lights although other types of lights may be used.

The light sources on the light board 170 may be different colors or otherwise have the ability to emit one color or multiple colors. These colors may include, but are not limited to, white, red, yellow, orange, green, blue and/or different shades thereof. The light board 170 may cause the lights to emit different colors based on, for example, the different operating modes of the non-lethal disruption device 100.

For example, when the non-lethal disruption device 100 is in the first operating mode, the light sources may be white and remain in a constant light emitting state. However, in the second operating mode, each light source may emit a different color at a different pattern or frequency. For example, a first light source may emit a green light, a second light source may emit a blue light and a third light source may emit a red light. The light sources may flash on and off in different patterns and frequencies. In some examples, the pattern and/or frequency of the flashing lights may be static. In another example, the pattern and/or frequency of the flashing lights may be dynamic over a period of time. For example, the light sources may flash in a first pattern or frequency for a first time frame in the period of time (e.g., 1 second) and flash in a second pattern or frequency for a second time frame (e.g., 1 second) in the period of time. In another example, a frequency range associated with the light sources and/or sound may sweep a programmed or predetermined range.

The non-lethal disruption device 100 may also include a top cap 180. The top cap 180 may be removably coupled to the headpiece 140 and may be used to secure the circuit board 150, the sound chamber 160 and the light board 170 within the headpiece 140. One or more protrusions 190 may extend from the top cap 180 such as shown in FIG. 1.

Figure 2:
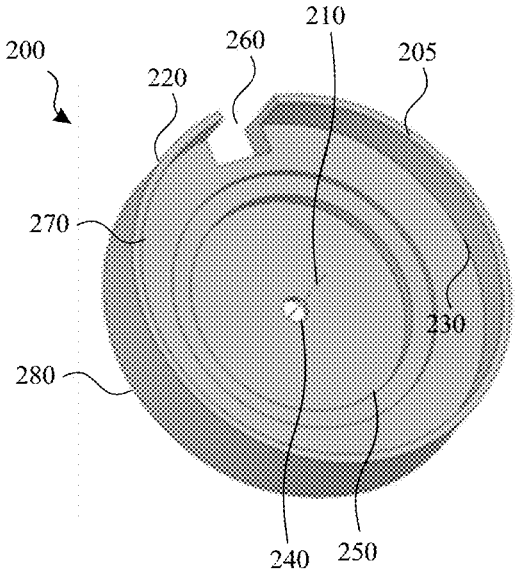
FIG. 2 illustrates a sound chamber for use in a non-lethal disruption device according to an example.

FIG. 2 illustrates a sound chamber 200 for use in a non-lethal disruption device according to an example. The sound chamber 200 may be similar to the sound chamber 160 shown and described with respect to FIG. 1.

In an example, the sound chamber 200 includes an annular body 205 extending about a central axis 210. The sound chamber 200 may have a radius of approximately twenty-two millimeters. In another example, the radius of the sound chamber 200 may be greater than twenty-two millimeters or less than twenty-two millimeters. The sound chamber 200 may include an inner sidewall 230 and an outer sidewall 220. The inner sidewall 230 and the outer sidewall 220 extend circumferentially about the center axis 240. The inner sidewall 230 may define an inner radius and the outer sidewall 220 may define an outer radius. As such, a width of the sidewall of the annular body 710 may be defined by a difference between the inner radius and the outer radius.

The annular body 205 has a top 270 and a bottom 280. The top 270 is open and is configured to at least partially receive or otherwise be coupled to a circuit board (e.g., circuit board 150 (FIG. 1)). The bottom 280 is opposite from the top 270. The bottom 270 is planar or substantially planar. The bottom 270 may include a piezo bender or diaphragm 250. The diaphragm may be offset (e.g., raised or lowered) from the bottom 270. The radius of the diaphragm 250 may be thirteen millimeters. In another example, the radius of the diaphragm 250 may be greater than thirteen millimeters or less than thirteen millimeters. The diaphragm 250 defines an aperture 240 or other opening. The aperture 240 enables the diaphragm to vibrate at the desired frequency when a non-lethal disruption device enters a second operating mode such as described herein.

As described above, the annular body 205 includes an outer edge 220 and an inner edge 230. The outer edge 220 and the inner edge 230 define a height of the sound chamber 200. In one example, the height of the sound chamber 200 is ten millimeters. In another example, the height of the sound chamber may be greater than ten millimeters or less than ten millimeters.

As shown in FIG. 2, the sound chamber 200 may define a channel 260. The channel 260 may be an opening that receives a connection mechanism of a light board (e.g., light board 170 (FIG. 1)). The channel 260 enables the light board to be connected to a circuit board of the non-lethal disruption device.

Figure 3:
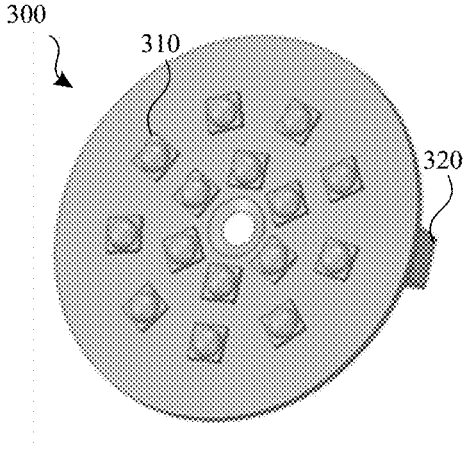
FIG. 3 illustrates a light board for use in a non-lethal disruption device according to an example.

FIG. 3 illustrates a light board 300 for use in a non-lethal disruption device according to an example. In an example, the light board 300 may be similar to the light board 170 shown and described above with respect to FIG. 1.

The light board 300 includes one or more light sources 310. The light sources 310 may be arranged in any suitable arrangement or pattern. The light sources 310 may be LED lights or some other light emitting mechanism. The light sources 310 may be different colors or otherwise have the ability to emit different colors depending on the determined or detected operating mode of a non-lethal disruption device. As indicated above, the light sources 310 may rapidly flash off and on in different patterns and/or at different frequencies and/or brightness during a second mode of operation.

The light board 300 also includes a connection mechanism 320. The connection mechanism 320 may enable the light board 300 to connect with a circuit board via a channel in a sound chamber such as previously described. The connection mechanism 320 enables the light board 300 to receive power from a power source (e.g., a battery) and/or emit light in the patterns specified by one or more circuits of the circuit board.

Figure 4:
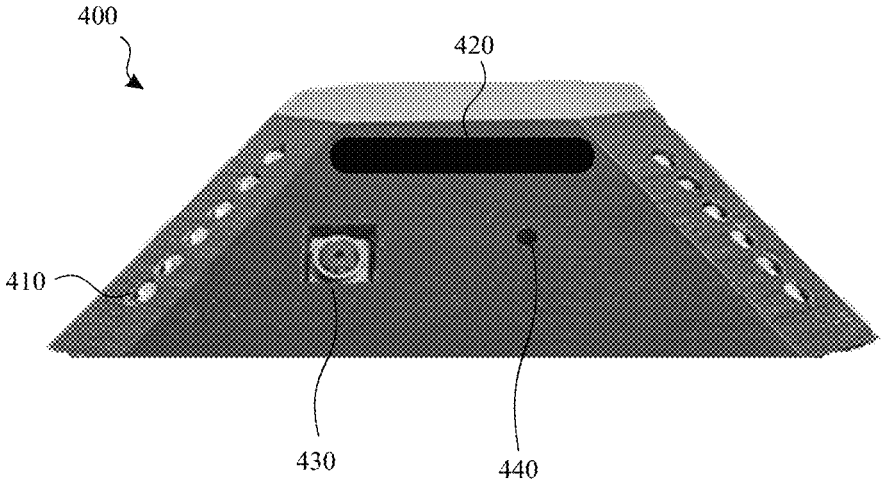
FIG. 4 illustrates another non-lethal disruption device according to an example.

FIG. 4 illustrates another non-lethal disruption device 400 according to an example. The non-lethal disruption device 400 may have similar features to the non-lethal disruption device 100 shown and described with respect to FIG. 1. For example, the non-lethal disruption device 400 may include one or more light sources 410 arranged in a particular pattern. The light sources 410 may be associated with a light board such as described herein.

Although the light sources 410 are vertically arranged on various sides of the non-lethal disruption device 400, in some examples, the light sources 410 may be arranged in any suitable pattern and/or on various sides of the non-lethal disruption device 400. The light sources 410 may be multi-colored LEDs or other light sources. The light sources 410 may have a luminosity range from 2000 mcd to 20000 mcd and wavelengths from 300 nm to 10,000K although other ranges are contemplated. The light sources 410 may also be at least partially enclosed in a housing that acts to the direct light toward an intended target. The housing may be adjustable—either manually or automatically (e.g., based information received from one or more sensors 430 associated with the non-lethal disruption device 400).

The non-lethal disruption device 400 may also include a sound chamber 420. The sound chamber 420 and the lights 410 may function in a similar manner as described above with respect to FIG. 1

In some examples, the non-lethal disruption device 400 may be mounted on a robotic unit and/or a remote-controlled device to enable the non-lethal disruption device 400 to enter a particular environment or setting while under the control of an operator and/or a computing device. For example, the non-lethal disruption device 400 may be mounted on a drone, a robot, or other remote-controlled device. The operator may then cause the non-lethal disruption device 400 to enter a particular area (e.g., residence, cave). In another example, the non-lethal disruption device 400 and/or the robotic unit may be controlled by or otherwise be associated with an artificial intelligence unit that controls or directs any movements and/or trigger events of the non-lethal disruption device 400.

In another example, the non-lethal disruption device 400 may be a throwable device. The throwable device may be triggered by pressing a button, selecting a time delay prior to throwing the throwable device, through an application executing on a computing device, and/or in response to one or more trigger events or conditions. The device may include a number of shapes including, but not limited to, a sphere, puck, cylinder, and the like.

In an example, in response to a trigger event, the light sources 410 and/or the sound chamber 420 may emit lights and sounds to confuse, disorient and disrupt an intended target. Light may be triggered without sound in some examples. Likewise, sound may be triggered without light. In an example, these options may be selectable by a user. In another example, a sensor module 430 may capture data and provide the data to a processor in order to analyze the surroundings and/or determine whether to activate lights alone, sound alone or a combination of lights and sounds. In one example, the sensor module 430 is a camera although other sensors may be used.

For example, the non-lethal disruption device 400 may include the following sensors and/or capabilities: stabilized 3600 color video; FR and/or thermal cameras; LiDAR mapping; geographic coordinate determination; remote connectability with other non-lethal disruption devices; facial recognition; wireless communication capabilities; motion detection; two way communication capabilities via a microphone and/or speaker 440; self-destruction capabilities and so on.

In some examples, one or more of the features described above may be activated and/or deactivated based, at least in part, on data that is received or otherwise detected by the one or more sensors and/or based on an operating mode of the non-lethal disruption device 400. For example, if sensor information received by or otherwise transmitted from the non-lethal disruption device indicates that the non-lethal disruption device has entered a sensitive or restricted area, a camera of the non-lethal disruption device may be automatically or manually deactivated.

A frequency range associated with the light sources 410 and/or sound may sweep a programmed range to create maximum disturbance to an intended target. In some examples, the sensors 430 may collect data about an intended target. For example, the sensors 430 may collect data regarding age, sex, and/or other determined factors associated with the target and determine variables in the hearing of human beings based on the data. As a result, a frequency sweeping process will account for the variables and dynamically create a different light and/or sound patterns/frequencies based on the data.

In some cases, the non-lethal disruption device 400 may be triggered manually from a remote control. In another example, the non-lethal disruption device 400 may be triggered autonomously in response to detection of a trigger event (e.g., when the non-lethal disruption device 400 senses motion when in a surveillance mode). In another example, the non-lethal disruption device 400 may be triggered in response to other sensor data (e.g., accelerometer data if the non-lethal disruption device 400 is picked up, thrown, kicked).

Figure 5:
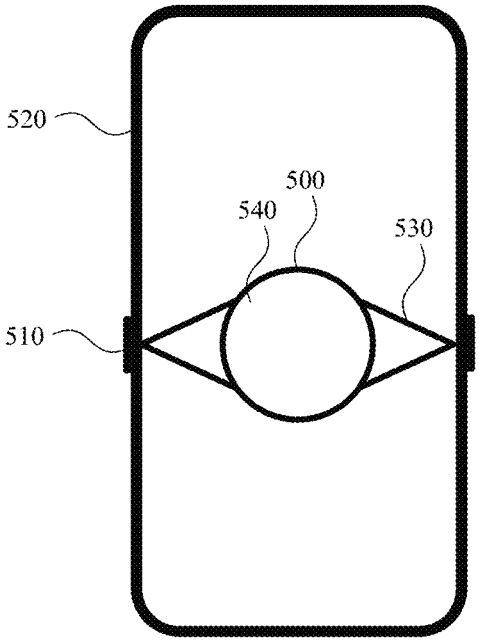
FIG. 5 illustrates yet another non-lethal disruption device according to an example.

FIG. 5 illustrates yet another non-lethal disruption device 500 according to an example. The non-lethal disruption device 500 may function in a similar manner and/or have the same or similar features to the other non-lethal disruption devices described herein.

In this example, the non-lethal disruption device 500 may include a sound chamber such as, for example, sound chamber 200 (FIG. 2) and/or one or more light sources. The non-lethal disruption device 500 may be mounted on or otherwise be removably attached to a computing device 520 such as, for example, a mobile phone. The non-lethal disruption device 500 may be removably coupled to the computing device 520 via one or more attachment mechanisms 530.

In an example, the one or more attachments mechanisms 530 may enable the non-lethal disruption device 500 to move from a first state or position (e.g., a state in which a bottom surface of the non-lethal disruption device 500 is resting on or otherwise adjacent to a housing of the computing device 520) to a second state or position (e.g., a state in which a bottom surface of the non-lethal disruption device 500 has moved away from resting on or otherwise adjacent to a housing of the computing device 520). As such a housing 540 associated with the non-lethal disruption device 500 may be used as a grip and/or a stand for the computing device 520.

The non-lethal disruption device 500 may also include one or more buttons 510. The buttons may be associated with or otherwise coupled to the one or more attachment mechanisms 530. Actuation of the one or more buttons 510 may cause lights and/or sounds to be emitted from the non-lethal disruption device 500 in a similar manner as described herein.

Figure 6:
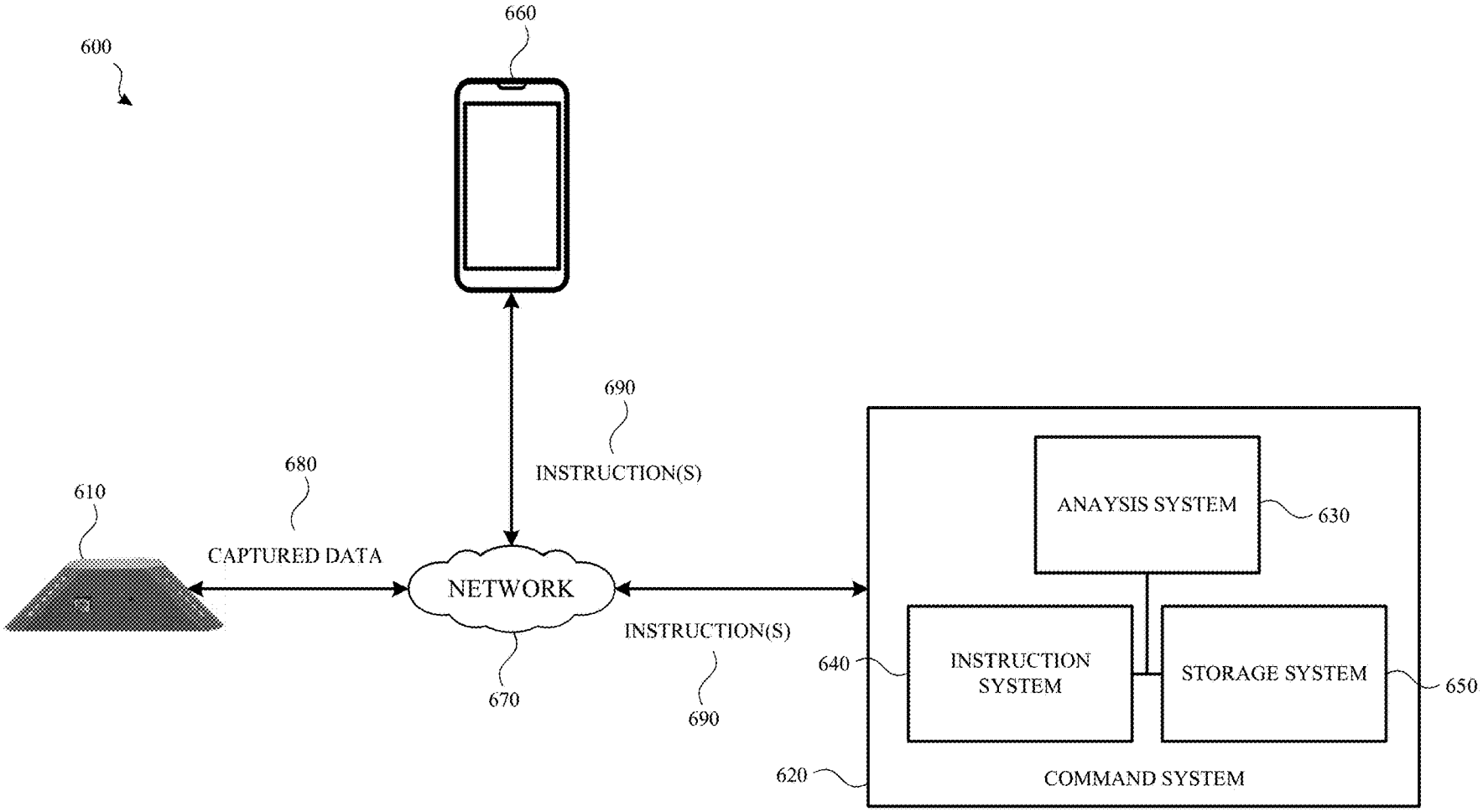
FIG. 6 illustrates a system in which a non-lethal disruption device may be used according to an example.

FIG. 6 illustrates a system 600 in which a non-lethal disruption device 610 may be used according to an example. The non-lethal disruption device 610 may be any of the non-lethal disruption devices described herein.

In the example shown in FIG. 6, the non-lethal disruption device 610 may be communicatively coupled to a command system 620. For example, the non-lethal disruption device 610 may be communicatively coupled to the command system 620 via a network 670 or other communication medium. The non-lethal disruption device 610 may also be communicatively coupled to a computing device 660 via the network 670 or other communication medium.

When deployed, the non-lethal disruption device 610 may capture data using one or more sensors. The captured data 680 may be captured in real-time or substantially real-time. The captured data 680 may then be provided to the computing device 660 and/or the command system 620 via the network 670 in real-time or substantially real-time.

In examples in which the captured data 680 is provided to the command system 620, the captured data 680 may be analyzed by the analysis system 630. The analysis system 630 may analyze the captured data 680 to determine various kinds of information including, but not limited to: demographic information about an individual targeted by the non-lethal disruption device 610; an environment in which the non-lethal disruption device 610 is placed; a number of individuals in a particular area in which the non-lethal disruption device 610 is placed; a state of one or more individuals in the particular area; an operating state of the non-lethal disruption device 610 and so on. The captured data 680 may also indicate which features of the non-lethal disruption device should be activated and/or deactivated. Thus, the non-lethal disruption device may intelligently determine, based on sensor data, which features may best handle a given situation when compared with other features. For example, if the sensor data indicates that the non-lethal disruption device 610 is in a dark cave, the camera may be deactivated or may otherwise stop capturing images but may instead, switch to LIDAR mapping, sending for heat signatures etc.

Based on the information determined by the analysis system, the instruction system 640 may generate and/or provide one or more instructions 690 for the non-lethal disruption device 610. The instructions 690 may include instructions for the non-lethal disruption device 610 to enter a particular state; to move to a particular area (e.g., when the non-lethal disruption device 610 is mounted to a moveable chassis); to capture additional or a different type of data; to enter an armed or unarmed state and the like; to output a particular sound and/or light pattern and the like. When the instructions 690 are received by the non-lethal disruption device 610, the non-lethal disruption device 610 will take an appropriate action. In some examples, the non-lethal disruption device 610 will continue to capture and/or transmit data when implementing the instructions 690.

As indicated above, in some examples, the captured data 680 may be provided to the computing device 660 in real-time or substantially real-time. In such examples, an operator of the computing device may analyze the captured data 680 and provide one or more instructions 690 to the non-lethal disruption device 610. In yet another example, the command system 620 may send the instructions 690 to the computing device 660 to enable an operator of the computing device 660 to determine which action, if any, the non-lethal disruption device 610 should take based on an analysis of the captured data 680. The operator of the computing device 660 may then communicate the instructions 690 to the non-lethal disruption device 610 via the network 670.

In some examples, the captured data 680 and/or the instructions 690 may be stored in a storage system 650 associated with the command system 620.

Figure 7:
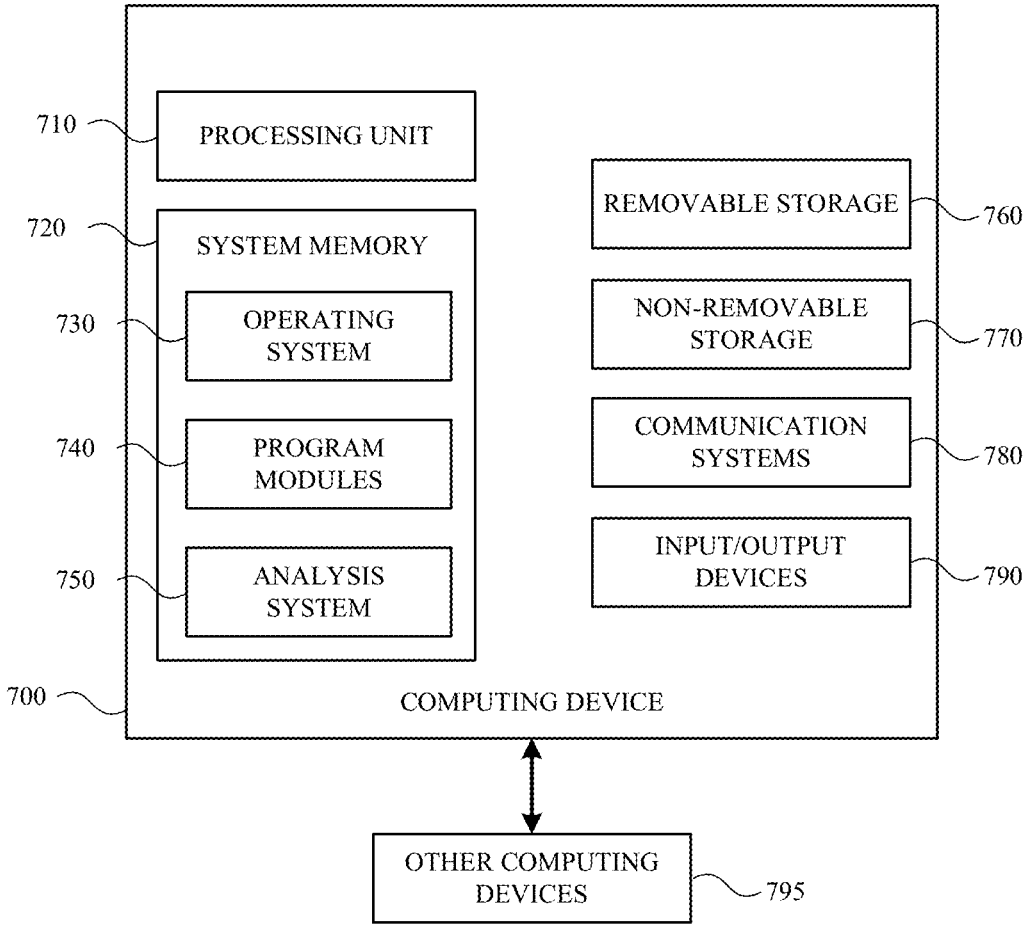
FIG. 7 is a block diagram illustrating example physical components of a computing device with which aspects of the disclosure may be practiced.

FIG. 7 is a system diagram of a computing device 700 according to an example. The computing device 700, or various components and systems of the computing device 700, may be integrated or associated with the command system and/or the various non-lethal disruption devices described herein. As shown in FIG. 7, the physical components (e.g., hardware) of the computing device 700 are illustrated and these physical components may be used to practice the various aspects of the present disclosure.

The computing device 700 may include at least one processing unit 710 and a system memory 720. The system memory 720 may include, but is not limited to, volatile storage (e.g., random access memory), non-volatile storage (e.g., read-only memory), flash memory, or any combination of such memories. The system memory 720 may also include an operating system 730 that controls the operation of the computing device 700 and one or more program modules 740. The program modules 740 may be responsible for executing and/or determining a which instructions should be provided to a non-lethal disruption device. For example, an analysis system 750 may receive captured data an determine one or more instructions that should be provided to the non-lethal disruption device. A number of different program modules and data files may be stored in the system memory 720. While executing on the processing unit 710, the program modules 740 may perform the various processes described above.

The computing device 700 may also have additional features or functionality. For example, the computing device 700 may include additional data storage devices (e.g., removable and/or non-removable storage devices) such as, for example, magnetic disks, optical disks, or tape. These additional storage devices are labeled as a removable storage 760 and a non-removable storage 770.

Examples of the disclosure may also be practiced in an electrical circuit comprising discrete electronic elements, packaged or integrated electronic chips containing logic gates, a circuit utilizing a microprocessor, or on a single chip containing electronic elements or microprocessors. For example, examples of the disclosure may be practiced via a system-on-a-chip (SOC) where each or many of the components illustrated in FIG. 7 may be integrated onto a single integrated circuit. Such a SOC device may include one or more processing units, graphics units, communications units, system virtualization units and various application functionality all of which are integrated (or "burned") onto the chip substrate as a single integrated circuit.

When operating via a SOC, the functionality, described herein, may be operated via application-specific logic integrated with other components of the computing device 700 on the single integrated circuit (chip). The disclosure may also be practiced using other technologies capable of performing logical operations such as, for example, AND, OR, and NOT, including but not limited to mechanical, optical, fluidic, and quantum technologies.

The computing device 700 may include one or more communication systems 780 that enable the computing device 700 to communicate with other computing devices 795 such as, for example, other non-lethal disruption devices, mobile telephones, communication radios and the like. Examples of communication systems 780 include, but are not limited to, wireless communications, wired communications, cellular communications, radio frequency (RF) transmitter, receiver, and/or transceiver circuitry, a universal serial bus (USB), parallel, serial ports, etc.

The computing device 700 may also have one or more input devices and/or one or more output devices shown as input/output devices 790. These input/output devices 790 may include a keyboard, a sound or voice input device, haptic devices, a touch, force and/or swipe input device, a display, speakers, etc. The aforementioned devices are examples and others may be used.

The term computer-readable media as used herein may include computer storage media. Computer storage media may include volatile and nonvolatile, removable and non-removable media implemented in any method or technology for storage of information, such as computer readable instructions, data structures, or program modules.

The system memory 720, the removable storage 760, and the non-removable storage 770 are all computer storage media examples (e.g., memory storage). Computer storage media may include RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other article of manufacture which can be used to store information and which can be accessed by the computing device 700. Any such computer storage media may be part of the computing device 700. Computer storage media does not include a carrier wave or other propagated or modulated data signal.

Communication media may be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, example, or detail provided in this application. Regardless of whether shown and described in combination or separately, the various features (both structural and methodological) are intended to be selectively included or omitted to produce an embodiment with a particular set of features. In addition, each of the operations described above may be executed in any order. For example, one operation may be performed before another operation. Additionally, one or more of the disclosed operations may be performed simultaneously or substantially simultaneously.

Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

The invention claimed is:

1. A non-lethal disruption device, comprising:
a switch associated with a housing;
a headpiece coupled to the housing;
a circuit board provided within the headpiece and controlling an operation of the non-lethal disruption device;
a sound chamber provided within the headpiece, the sound chamber for emitting a sound at a particular frequency; and
a plurality of light sources arranged in a pattern on a light board provided within the headpiece, the plurality of light sources having multiple colors;
wherein the non-lethal disruption device:
operates in a first operation mode in which a first subset of the plurality of light sources emit a first type of light in response to a first actuation of the switch; and
operates in a second operation mode in which a second subset of the plurality light sources emit a second type of light, including colored light, and the sound chamber emits the sound in response to a second actuation of the switch.

2. The non-lethal disruption device of claim 1, wherein the first operation mode is a flashlight mode.

3. The non-lethal disruption device of claim 1, wherein the second operation mode is a disruption mode.

4. The non-lethal disruption device of claim 1, wherein the second type of light is a pattern and wherein the second subset of the plurality of light sources include the multiple colors.

5. The non-lethal disruption device of claim 1, wherein the second subset of the plurality of light sources is output at first frequency at a first time and a second frequency at a second time.

6. The non-lethal disruption device of claim 1, wherein the sound chamber operates at a resonant frequency of approximately 3700 Hz.

7. The non-lethal disruption device of claim 1, wherein the sound emitted by the sound chamber is associated with a frequency range.

8. The non-lethal disruption device of claim 1, wherein:
the first actuation of the switch is a first type of actuation; and
the second actuation of the switch is a second type of actuation that is different than the first type of actuation.

9. The non-lethal disruption device of claim 1, wherein the switch is remote from the housing.

10. A non-lethal disruption device, comprising:
a body;
a headpiece provided on a distal end of the body, the headpiece housing:
a circuit board;
a sound chamber; and
a light board including a plurality of light sources, each light source of the plurality of light sources emitting light in one or more colors; and
a top cap coupled to the headpiece, the top cap including a number of protrusions and operable to secure the circuit board, the sound chamber and the light board within the headpiece, wherein the non-lethal disruption device:
is operable in a first mode in which a first subset of the plurality of light sources emit a first type of light; and
is operable in a second mode in which a second subset of the plurality light sources emit a second type of light and the sound chamber emits a sound.

11. The non-lethal disruption device of claim 10, further comprising an end cap provided on a proximal end of the body.

12. The non-lethal disruption device of claim 11, wherein the end cap includes a switch.

13. The non-lethal disruption device of claim 10, wherein at least a portion of the circuit board mates with the sound chamber.

14. The non-lethal disruption device of claim 10, wherein the sound chamber includes a sound amplifying device.

15. The non-lethal disruption device of claim 14, wherein the sound amplifying device is selected from a group, comprising:
a diaphragm; and
a piezo bender.

16. The non-lethal disruption device of claim 10, wherein the sound chamber operates at a resonant frequency of 3700 Hz and a capacitance of 48000 pF at 120 Hz.

17. A non-lethal disruption device, comprising:
a body;
an end cap removably coupled to a proximal end of the body;
a headpiece removably coupled to a distal end of the body;
a circuit board provided within the headpiece;
a sound chamber provided within the headpiece; and
a light board provided within the headpiece, the lightboard including a plurality of light sources that are operable in a plurality of different modes; and
a top cap removably coupled to the headpiece, the top cap including a number of protrusions and operable to secure the circuit board, the sound chamber and the light board within the headpiece.

18. The non-lethal disruption device of claim 17, wherein the end cap is associated with a switch.

19. The non-lethal disruption device of claim 17, further comprising a remote switch.

20. The non-lethal disruption device of claim 17, wherein the sound chamber includes one of a diaphragm and a piezo bender.

* * * * *